United States Patent [19]

Gray

[11] 4,262,881

[45] Apr. 21, 1981

[54] BOTTLE JACK ANTI-BIND STRUCTURE FOR RECTANGULAR LIFT POST

[75] Inventor: Joseph L. Gray, St. Joseph, Mo.

[73] Assignee: Gray Manufacturing Co., Inc., St. Joseph, Mo.

[21] Appl. No.: 60,746

[22] Filed: Jul. 25, 1979

[51] Int. Cl.[3] ..... B66F 3/24

[52] U.S. Cl. ..... 254/93 R; 92/167; 92/168

[58] Field of Search ..... 254/93 H, 93 R, DIG. 1, 254/DIG. 4, 101, 2 R, 2 B; 92/167, 168

[56] References Cited

U.S. PATENT DOCUMENTS

| | | | |
|---|---|---|---|
| 373,072 | 11/1887 | Jarvis | 92/167 |
| 3,046,062 | 7/1962 | Wettstein | 92/168 |
| 3,311,030 | 3/1967 | Halstead | 92/167 |
| 3,730,481 | 5/1973 | Ekonen et al. | 254/93 R |
| 3,881,692 | 5/1975 | Clarke | 254/DIG. 1 X |

*Primary Examiner*—Robert C. Watson

*Attorney, Agent, or Firm*—Schmidt, Johnson, Hovey & Williams

[57] ABSTRACT

Anti-binding structure for jacks is provided which eliminates load-induced binding between an extended jack lift post and the guide structure therefor, so as to facilitate smooth jack operation. The jack of the invention preferably includes a rectangular or sqaure cross section lift post and a plurality of elongated, transversely U-shaped bearing channels respectively disposed between the planar post faces and the upper guide plate of the jack; the channels are each mounted for limited rocking movement about respective axes transverse to the longitudinal axis of the jack post so that any load-induced canting or deflection of the post can be safely accommodated without binding or galling thereof.

6 Claims, 6 Drawing Figures

BOTTLE JACK ANTI-BIND STRUCTURE FOR RECTANGULAR LIFT POST

BACKGROUND OF THE INVENTION

1. Field of the Invention

The present invention is concerned with article lifting or moving devices which include elongated, axially reciprocal lift posts having circumscribing guide means therearound. More particularly, it is concerned with devices of this type (such as so-called bottle jacks) which are improved by provision of anti-binding structure for preventing load-induced binding of the jack components, especially between the lift post and guide means of the jack.

2. Description of the Prior Art

Various types of jacks or article-lifting apparatus have been proposed in the past. Generally speaking, such units include an elongated, tubular axially reciprocal lifting post, along with means operatively coupled to the lift post for elevating and lowering the same as desired. Additionally, plate-type means for guiding the reciprocal travel of the lift post is a conventional feature.

One particular type of jack in use today is an air stand which is also known as a bottle jack. In such devices an air chamber having a shiftable piston therein is provided, with the lift post of the jack being secured to the piston. The upper end of the chamber is defined by an apertured guide plate through which the lift post passes. Means is also provided for filling the chamber beneath the piston with pressurized air to extend the lift post, and for release of air from the chamber to lower the lift post. The concepts of this invention may also be used with equal facility in hydraulically actuated lifting or moving devices.

A problem heretofore encountered with certain types of jacks, and particularly the so-called bottle jacks, involve load-induced binding of the jack components. For example, the lift post or ram can bind against the guide plate structure when the post is in an extended position, or the piston can bind against the chamber wall. This sort of binding most commonly occurs when an unevenly distributed load cants or deflects the jack post transversely of the longitudinal axis thereof, with the result that the post and/or piston bind against adjacent structure. This problem has been known to be so severe as to lead to rough operation, or freeze the jack and prevent post or ram movement. Furthermore, the galling of the metallic jack components incident to load-induced binding is an objectionable result.

There is therefore a need in the art for an improved jack which includes an anti-binding structure or mechanism which eliminate the problems described above.

Prior jacks and lifting apparatus are described in U.S. Pat. Nos. 2,360,735, 2,961,837, 3,087,626, 3,250,503, 3,286,970, 3,567,183 and 3,866,899.

DESCRIPTION OF THE PREFERRED EMBODIMENT

Figure 1:
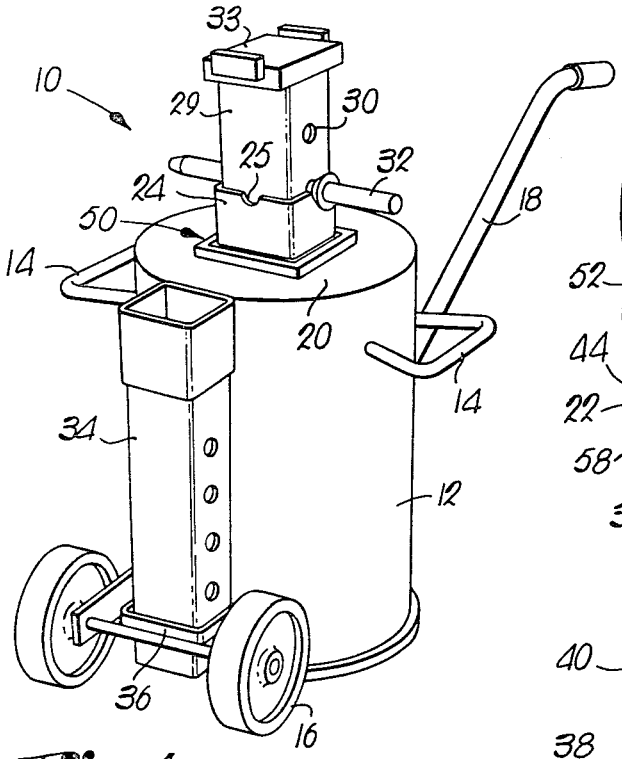
FIG. 1 is a perspective view of a bottle-type jack in accordance with the invention.
Figure 6:
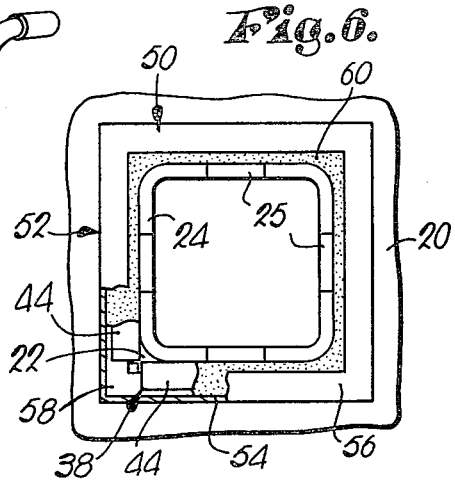
FIG. 6 is a plan view similar to that of FIG. 4 with parts broken away for clarity to illustrate the upper seal provided about the anti-binding structure.

Turning now to the drawing, a bottle jack 10 in accordance with the invention is illustrated perspectively in FIG. 1 and includes elongated, upright air cylinder 12 having a pair of handles 14 secured thereto, along with wheels 16 and an elongated, obliquely oriented guide handle 18. The upper end of cylinder 12 is defined by an apertured, circular plate 20 having a generally square opening 22 centrally disposed therein. An elongated, generally square in cross-section, axially reciprocal lift post 24 having four planar faces is received within the aperture 22 and is slidable relative to the latter. Four notches 25 are provided in the upper margin of the post 24.

A circular piston 26 (see FIGS. 2 and 3) is disposed within the cylinder 12 beneath plate 20, and is fixedly secured to the lower end of post 24. A resilient (preferably linear polyethylene) ring 27 is disposed about the periphery of piston 26, and a depending resilient annular seal 28 is secured to the lowermost face of piston 26, in order to create a deformable pressure tight seal about the piston.

Post 24 is provided with a tubular, substantially square cross-section, article-engaging extension 29 which telescopes within the post and has mated pairs of transversely extending openings 30 through respective opposed planar faces thereof. An elongated, removable locking bar element 32 adapted to extend transversely through a respective mated pair of openings 30 and seat within a pair of notches 25 is further provided for locking the extension 29 at a desired elevated position relative to post 24. In this connection, extension 29 has an article-engaging pad 33 at the upper end thereof; and a secondary, apertured extension 34 normally carried externally of bottle 12 in a retention ring 36 can be coupled to the extension 29 for increasing the lifting height of the overall jack 10.

Figure 5:
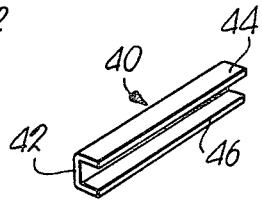
FIG. 5 is a perspective view of one of the preferred bearing members forming a part of the anti-binding structure.

Anti-binding structure broadly referred to by the numeral 38 is provided in jack 10 for the purpose of preventing load-induced binding between lift post 24 and the defining margins of the post-clearing aperture 22. Broadly speaking, the structure 28 includes bearing means disposed between the post 24 and the guide plate 20 for engaging each of the latter, with the bearing means being mounted for limited rocking movement about an axis transverse of the longitudinal axis of the post 24. In particular, the preferred anti-binding structure 38 includes four independent, elongated, U-shaped in cross-section channels 40 each including a bight 42 and respective spaced legs 44 and 46 (see FIG. 5).

Figure 2:
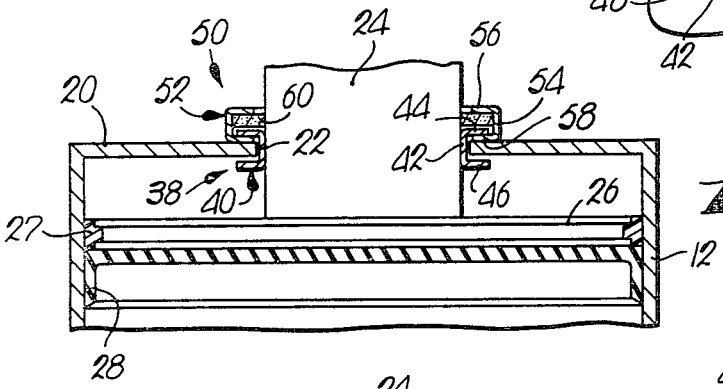
FIG. 2 is a fragmentary view in partial vertical section illustrating a portion of the internal construction of the jack as well as the anti-binding structure provided therewith.
Figure 3:
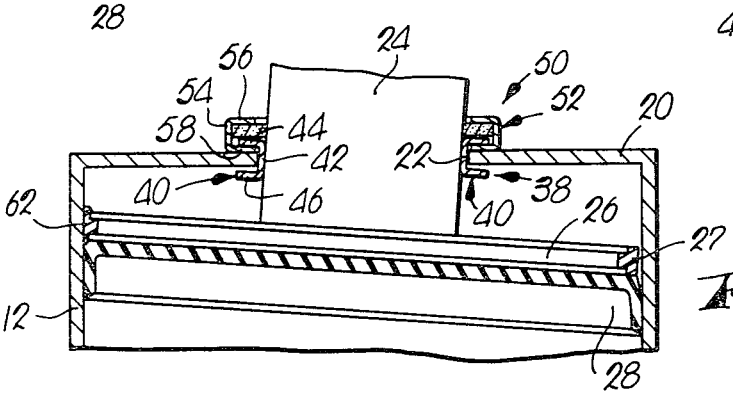
FIG. 3 is a view similar to that of FIG. 2 but depicts the action of the anti-binding structure in accommodating load-induced canting or deflection of the lift post of the jack without binding of the latter.

Each of the channels 40 is disposed adjacent to one of the rectilinear stretches defining the opening 22 such that the bight 42 thereof is located for engagement with the post 24 and the proximal margin of the plate 20. As best seen in FIGS. 2 and 3, in such disposition each channel 40 has the legs 44, 46 thereof respectively disposed proximal to opposite faces of the plate 20; moreover, the legs 44, 46 are spaced apart a substantially greater difference than the thickness of the plate 20 so as to provide a loose, rockable fit relative to the plate 20.

Figure 4:
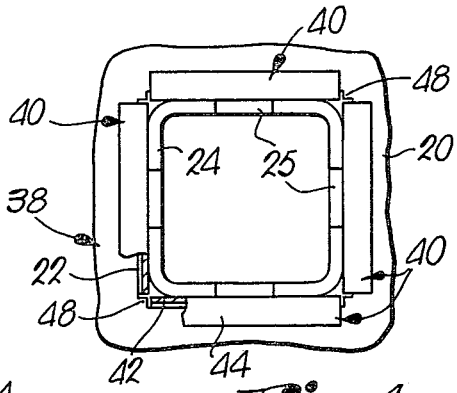
FIG. 4 is a fragmentary plan view with parts broken away for clarity illustrating the disposition of the respective bearing means about the periphery of the jack post.

Referring to FIG. 4, it will be seen that the post-clearing opening 22 has, at each corner thereof, a square, inwardly extending projection 48. Each of the channels 40 fits between corresponding pairs of projections 48, such that the latter serve to maintain the channels in their proper bearing disposition. The projections 48 also serve to minimize the open area presented between the post 24 and the margins of the opening 22.

Continuous sealing structure 50 is disposed about the post 24 adjacent the anti-binding structure 38. The rectangular sealing structure 50 has four interconnected, elongated, U-shaped in cross-section channel sections 52. Each channel section 52 includes a bight 54 and spaced legs 56, 58. Again referring to FIGS. 2 and 3, it will be seen that each of the channels 40 telescopes over a corresponding channel section 52 of structure 50 thereby holding the seal in place. Sealing structure 50 is completed by provision of rubber, felt-like or equivalent sealing material 60 operatively disposed within the channel sections 52 and in wiping engagement with the respective exterior surfaces including the planar faces of lift post 24. It will also be observed that the upper leg 44 of each anti-binding channel 40 is loosely disposed between a corresponding sealing channel leg 58 and the sealing material 60; this further assures that the respective anti-binding channels 40 are maintained in their operative positions during use of jack 10.

During use of jack 10, air is injected into the chamber 12 beneath piston 26 and, in the usual fashion, this serves to shift piston 26 and lift post 24 upwardly. In the event that an uneven load tends to laterally deflect or cant the lift post 24, the anti-binding structure 38 comes into play. Specifically, the respective, rockably mounted channels 40 serve to accommodate such limited deflection or canting without permitting the post 24 to bind against the margins of the opening 22. This operation is illustrated in FIG. 3, wherein it will be seen that the left and right hand channels 40 are each appropriately rocked about respective axes transverse of the longitudinal axis of the post 24, so as to safely accommodate the depicted, load-induced canting.

It will also be seen from a study of FIG. 3 that the polyethylene ring 27 deforms as at 62 so as to prevent the piston 26 from binding or galling against the circular sidewall of chamber 12. Of course, the depending seal 28 serves to maintain the proper air tight seal beneath the piston 26.

Although in the preferred embodiment, the ram is shown as being transversely rectangular in cross-section, a circular ram may be employed in which event a series of channels may be disposed around the perimeter of the ram to prevent binding. For example, an elongated channel may be used wherein the opposed legs are cut down to the bight and the segments thus presented spread so that the articulated plate may partially or completely circumscribe the ram.

It will thus be appreciated that the elevating and lowering operation of jack 10 can be accomplished without fear of dangerous binding and/or galling between the jack components. Furthermore, the simplicity of the anti-binding structure is a decided advantage.

Having thus described the invention, what is claimed as new and desired to be secured by Letters Patent is:

1. In article-moving apparatus including an elongated, axially reciprocal, transversely rectangular ram, means operatively coupled to the ram for shifting the same as desired, and means including plate structure defining a ram-clearing opening conforming generally in shape to the cross-sectional configuration of the ram for guiding the reciprocal travel of said ram, the improvement which comprises:

structure for preventing load-induced binding between said ram and said guiding means in the event said ram is deflected transversely of the longitudinal axis thereof, said bind-preventing structure including bearing means disposed between said ram and guide means for engaging each of the latter, said bearing means being mounted in said disposition for limited rocking movement about an axis transverse of the longitudinal axis of said ram, said bind-preventing structure including at least one U-shaped element disposed with the bight thereof for said engagement, and with the legs thereof respectively disposed adjacent opposite faces of said opening-defining plate structure.

2. Apparatus as set forth in claim 1 wherein said element comprises an elongated channel.

3. Apparatus as set forth in claim 1 includin a separate element disposed for engagement with each planar face of said ram.

4. Apparatus as set forth in claim 1 including sealing means about said post adjacent said bind-preventing structure.

5. Apparatus as set forth in claim 1 wherein said post is substantially square in cross-section.

6. Apparatus as set forth in claim 1 wherein:

said bind-preventing structure comprises a plurality of elongated channels respectively disposed for engagement with a separate planar face portion of said ram along substantially the entire transverse extent of each of the separate face portion;

said opening defining structure presents a post-clearing opening having, at each of the corners thereof, an inwardly extending projection for maintaining said channels in said disposition.

* * * * *